US007997283B2

(12) United States Patent
Fracassi et al.

(10) Patent No.: US 7,997,283 B2
(45) Date of Patent: Aug. 16, 2011

(54) ARTIFICIAL NAILS INCLUDING APPLICATION TABS

(75) Inventors: Joseph Michael Fracassi, Lake Forest, CA (US); Jeanine Catherine Coppola, Irvine, CA (US)

(73) Assignee: Pacific World Corporation, Lake Forest, CA (US)

( * ) Notice: Subject to any disclaimer, the term of this patent is extended or adjusted under 35 U.S.C. 154(b) by 439 days.

(21) Appl. No.: 11/739,371

(22) Filed: Apr. 24, 2007

(65) Prior Publication Data

US 2008/0264436 A1 Oct. 30, 2008

(51) Int. Cl.
*A45D 29/00* (2006.01)

(52) U.S. Cl. ..... 132/73

(58) Field of Classification Search ..... 132/73, 132/73.5, 76.5; D28/56, 57, 61
See application file for complete search history.

(56) References Cited

U.S. PATENT DOCUMENTS

| | | | | |
|---|---|---|---|---|
| 2,239,040 | A | | 4/1941 | Holmes |
| D136,030 | S | | 7/1943 | Belmonte et al. |
| 2,417,677 | A | | 3/1947 | Cohan |
| 2,941,535 | A | | 6/1960 | Lappe |
| 3,157,912 | A | | 11/1964 | Lisczawka |
| 3,552,401 | A | | 1/1971 | Michaelson |
| 3,578,158 | A | | 5/1971 | Aylott |
| 3,722,104 | A | | 3/1973 | Enzetti |
| 3,982,551 | A | | 9/1976 | Bartolucci |
| 3,993,084 | A | | 11/1976 | Cullen |
| 4,007,748 | A | | 2/1977 | Matranga et al. |
| 4,106,614 | A | * | 8/1978 | Aylott ..... 206/581 |
| 4,346,720 | A | | 8/1982 | Hokama |
| 4,554,935 | A | | 11/1985 | Hokama |
| 4,625,740 | A | | 12/1986 | Roth |
| 4,718,957 | A | | 1/1988 | Sensenbrenner |
| 4,751,935 | A | | 6/1988 | Mast et al. |
| 4,805,645 | A | | 2/1989 | Schiff et al. |
| D309,196 | S | | 7/1990 | LaJoie |
| 5,005,595 | A | | 4/1991 | Aylott |
| 5,060,678 | A | | 10/1991 | Bauman et al. |
| 5,070,892 | A | | 12/1991 | Trematerra |
| 5,209,250 | A | | 5/1993 | Taeckens |
| 5,450,864 | A | | 9/1995 | LaJoie et al. |
| 5,513,664 | A | | 5/1996 | Krupsky |
| D376,224 | S | | 12/1996 | Fojon |
| 5,676,165 | A | | 10/1997 | Bannett |
| D386,823 | S | | 11/1997 | Carroll et al. |
| 5,791,482 | A | | 8/1998 | Murphy et al. |
| 5,816,408 | A | | 10/1998 | Indelicato |
| 5,832,936 | A | | 11/1998 | Pruchnic et al. |

(Continued)

FOREIGN PATENT DOCUMENTS

| | | |
|---|---|---|
| EP | 0167329 | 7/1956 |

(Continued)

*Primary Examiner* — Rachel Steitz
(74) *Attorney, Agent, or Firm* — Leydig, Voit & Mayer, Ltd.

(57) ABSTRACT

A preformed artificial nail assembly comprising an artificial nail sized to correspond to at least a portion of said natural nail, and an application tab extending from the distal end of the artificial nail, the application tab having a neck portion and a body portion, said neck portion being disposed between the body portion and the distal end of the artificial nail, the body portion being disposed at an angle to the artificial nail such that the body may be readily grasped by the user to facilitate placement of the artificial nail on the natural nail. An embodiment includes an application tab that twists from its connection to the nail to the tab body.

20 Claims, 6 Drawing Sheets

U.S. PATENT DOCUMENTS

| | | | |
|---|---|---|---|
| 5,860,429 | A | 1/1999 | Chang |
| 5,901,714 | A | 5/1999 | Benkart |
| 5,944,027 | A | 8/1999 | Chang |
| D433,536 | S | 11/2000 | Schwartz |
| 6,196,234 | B1 | 3/2001 | Gifford |
| D441,134 | S | 4/2001 | Manzione |
| 6,220,250 | B1 | 4/2001 | Park |
| 6,328,039 | B1 | 12/2001 | Chang |
| 6,354,304 | B1 | 3/2002 | Chang |
| D455,866 | S | 4/2002 | Baltierra |
| 6,892,736 | B2 | 5/2005 | Chang et al. |
| D525,747 | S | 7/2006 | Robinson |
| 7,100,619 | B2 | 9/2006 | Kim |
| 7,150,281 | B2 | 12/2006 | Han |
| 7,185,660 | B1 | 3/2007 | Han |
| 7,337,783 | B2 | 3/2008 | Han |
| 7,389,876 | B2 | 6/2008 | Hong et al. |
| 2002/0023656 | A1 | 2/2002 | Chang |
| 2003/0178040 | A1 | 9/2003 | Swensen |
| 2004/0079381 | A1 | 4/2004 | Han |
| 2004/0173232 | A1 | 9/2004 | Chang et al. |
| 2004/0216757 | A1 | 11/2004 | Chang |
| 2005/0121048 | A1 | 6/2005 | Han |
| 2005/0183735 | A1 | 8/2005 | Robinson |
| 2005/0217686 | A1 | 10/2005 | Lee |
| 2005/0268931 | A1 | 12/2005 | Chang |
| 2006/0191551 | A1 | 8/2006 | Han |
| 2006/0237027 | A1 | 10/2006 | Han |
| 2007/0107745 | A1 | 5/2007 | Kiyomoto |
| 2007/0224288 | A1 | 9/2007 | Kim |
| 2007/0277841 | A1 | 12/2007 | Kim |
| 2008/0017211 | A1 | 1/2008 | Han |
| 2008/0017212 | A1 | 1/2008 | Han |
| 2008/0017213 | A1 | 1/2008 | Han |
| 2008/0017214 | A1 | 1/2008 | Han |
| 2008/0099037 | A1 | 5/2008 | Chang |
| 2008/0251092 | A1 | 10/2008 | Han |

FOREIGN PATENT DOCUMENTS

| | | | |
|---|---|---|---|
| EP | 1415567 | | 5/2004 |
| EP | 1902644 | | 3/2008 |
| EP | 1902645 | | 3/2008 |
| EP | 01902645 | | 3/2008 |
| EP | 01920675 | | 5/2008 |
| FR | 2534120 | | 4/1984 |
| GB | 752960 | | 5/1954 |
| GB | 725969 | | 3/1955 |
| JP | 2002034641 | | 2/2002 |
| JP | 2004081843 | | 3/2004 |
| JP | 2006181349 | | 7/2006 |
| KR | 2002-008283 | | 1/2002 |
| KR | 20-0327518 | Y1 | 9/2003 |
| KR | 2004059956 | | 7/2004 |
| KR | 10-2005-0079081 | | 8/2005 |
| KR | 605671 | | 8/2006 |
| KR | 10-2006-0090416 | | 9/2006 |
| KR | 10-2006-0090417 | | 9/2006 |
| KR | 10-2006-0104330 | | 10/2006 |
| KR | 10-2004-0659692 | B1 | 12/2006 |
| KR | 737424 | | 7/2007 |
| KR | 765332 | | 10/2007 |
| KR | 438231 | Y1 | 2/2008 |
| WO | WO 2006/062963 | | 6/2006 |
| WO | WO 2008/111759 | | 9/2008 |

* cited by examiner 30
31
22
34
36
32
33
80
54
50
112
3 NAME
52

37
38
80
50
54
33
52

33
80
50
54
52
3 NAME
112

ARTIFICIAL NAILS INCLUDING APPLICATION TABS

FIELD OF THE INVENTION

The present invention relates to human nail decorations, and more specifically the invention pertains to structure and methods for placement of preformed artificial nails and tips for adherence to human nails.

BACKGROUND OF THE INVENTION

For various aesthetic reasons, many individuals wish to possess elongated fingernails or fingernails having a more finished or polished appearance. However, some are unable or unwilling to grow their own natural fingernails out to the desired length. Alternately, they may not have the time, skill, or financial wherewithal to maintain or obtain a more finished appearance that may result from well manicured and/or polished nails. As a result, entire industries have developed around the artificial supplementation and enhancement of natural nails. Such enhancements may range from manicuring and polishing of natural fingernails to individually building artificial nails on the natural nail and nail form from an acrylic powder and liquid which chemically bond to the nail surface as the artificial nail is built. Between these two extremes, are preformed, artificial nails that are glued or otherwise bonded to a person's own naturally occurring fingernails. Such nails are readily available to a wide range of users through drug and department stores. Such preformed artificial nails may be clear or opaque, and/or prepolished and/or decorated to provide the desired appearance.

Artificial nails are commonly made from molded thermoplastic and are available in a wide range of lengths and styles. One broad category of an artificial nail style is the full nail form. As its name implies, the full nail form simulates the entire human fingernail and includes a proximate edge intended to overlay substantially the entire nail bed and a distal free edge which is intended to extend beyond the fingertip of the wearer. The proximate edge is shaped to be disposed substantially adjacent or abut against the cuticle of the finger. The distal free edge may have any of various lengths and shapes, such as oval, square, or flared, depending upon the desired look. Preferably, the artificial nail is sufficiently durable and rigid to withstand the hazards inherent in its use.

In contrast, nail tips do not simulate the complete nail, but, rather, only the free edge and, typically, a small extended portion to cover only a portion of the nail bed in order to facilitate attachment to the nail. In use, nail tips are secured to the edge of the nail bed adjacent the free edge and the tip only. Tips are often utilized with the construction of acrylic nails or gel nails.

Manufacturers typically provide users with a range of nail sizes, e.g., identified by size numbers 0-9, to accommodate most nail sizes. Generally, artificial nails are packaged together in sets including a range of different sizes so that the purchaser receives differently artificial nails for their different fingers. In addition to the set of different sized artificial nails, the package may also include liquid adhesive, peel-off adhesive pads, and/or preplaced tacky adhesive for bonding the artificial nails to the purchaser's natural fingernails.

Artificial nails are provided in a variety of lengths ranging from relatively long nails having either a straight profile or arched profile, to relatively short nails, which more closely simulate well groomed natural nails. In placement of the artificial nail on a user's natural nail, the adhesive is typically applied either directly to the user's natural nail bed or to the nail bed portion of the artificial nail. The artificial nail is then placed on the user's natural nail bed with the proximal end of the artificial nail disposed at or near the user's cuticle, and pressure is applied to ensure the desired adhesion of the artificial nail to the user's natural nail. Inasmuch as the adhesive used in placing artificial nails is generally tacky, it is difficult to make adjustments to the position of the artificial nail on the natural nail once initial placement is made. Attempts to reposition the artificial nail relative to the natural nail or to remove and replace the artificial nail may result in either a substandard appearance to the artificial nail, or time consuming additional cleaning of the artificial nail and repetition of the placement process. As a result, it is important that the artificial nail be placed at the desired position on the natural nail at the first attempt so as to avoid the need to remove and reposition the nail.

Longer artificial nails typically extend well beyond the free edge of the user's natural nails. Consequently, in placing relatively long artificial nails on the user's natural nails, one may generally utilize the extended free edge of the artificial nail to hold the artificial nail prior to placement, and to manipulate and accurately position the artificial nail on the user's nail bed. When utilizing smaller artificial nails, however, the free edge is very short, and does not extend far beyond the user's natural nail or finger tip, if at all. Accordingly, such short nails can be particularly difficult to accurately place on the user's natural nail by simply grasping the artificial nail using one's fingers.

As a result, manufacturers have proposed various tools to allow for holding and placing artificial nails during application. One such tool is comprises an elongated rod with a tacky adhesive pad or tape at the end of the tool to grip the artificial nail, such as the tools shown in U.S. Pat. No. 6,220,250 to Park and the tool marketed by Sally Hansen®. This tacky, adhesive pad, however, has proven unreliable in use, however, inasmuch as the retaining force exerted by the adhesive on the artificial nail typically deteriorates over time such that it does not exert a consistent retaining force on the artificial nail. Moreover, should the adhesive pad become contaminated with dust or the like, it becomes generally useless in that it does not exhibit adequate force to retain a series of nails for placement.

Another such tool is shaped like a concave shovel with a shorter opposing lip that is disposed parallel to the shovel such that a small slot or gap is formed between the inside surface of the shovel and the lip, as shown in U.S. Pat. D441, 134 to Manzione and marketed by Uptown Nails, LLC. In use, the outer, arched surface of the artificial nail is disposed against the inside surface of the shovel with the free edge of the artificial nail disposed in the gap between the lip and the shovel. This tool likewise exhibits deficiencies. While the "shovel" tool does not deteriorate with use, it is cumbersome to utilize. Should the gap between the shovel and lip be sufficiently small to exert a retaining force on the artificial nail, the user will typically be required to exert an external downward, retaining force on the artificial nail when it is placed against the natural nail in order to facilitate release of the artificial nail by the tool. Inasmuch as the user's free hand grasps the tool, the user must typically use a different finger from the placement hand to exert a retaining force the placed artificial nail to facilitate release of artificial nail from the tool. Conversely, if the tool does not exert adequate retaining force to hold the artificial nail during the placement process, the tool may allow artificial nail to move within the gap, making accurate placement of the artificial nail against the natural nail significantly more difficult.

The assignee of the present invention has proposed a tool that utilizes a small suction cup disposed at the distal end of an elongated rod. In applying an artificial nail to a natural nail, the user places the suction cup on the upper surface of the artificial nail and expels any air trapped between the cup and the nail. The user then utilizes the tool to position the artificial nail on the natural nail. The suction cup provides sufficient force to retain the nail during placement, yet that force is overcome by the tackiness of the adhesive or the adhesive bond between the artificial nail and the natural nail once properly placed. The tool is disclosed in greater detail in PCT Publication WO06/062963A.

Manufacturers have likewise proposed severable protrusions that extend from one or more edges of the artificial nail themselves. The protrusions are utilized to place the artificial nail and then severed from the nail once proper placement has been achieved. For example, U.S. Pat. No. 6,892,736 to Chinn et al. includes a tab that extends from the distal edge of the nail. Unfortunately, however, the Chinn tab is not ergonomic, and is difficult and cumbersome to use. As may be seen in FIG. 11, the Chinn tab 13 must typically be held between a finger 14 and the thumb 15 of the applying hand 16, the thumb 15 being disposed either below or above the plane of the artificial nail 17. Accordingly, the user's hand 16 is in an awkward position relative to the receiving finger. As a result, typically, either a separate finger from the receiving hand must be used to securely seat the artificial nail 17 in position on the natural nail during severing of the nail tab 13, or the user must hold the artificial nail 17 in position until such time as the adhesive fully cures. Similar difficulties are encountered in placing the nails disclosed in other references, such as U.S. Pat. No. 5,005,595 to Aylott, for example.

As a result, it is desirable to provide a nail placement arrangement that overcomes these shortcomings of the prior art to provide for accurate and reliable, repeatable placement of artificial nails.

BRIEF SUMMARY OF THE INVENTION

The invention provides a nail application tab that extends generally from the distal end of the nail, the body of the application tab being disposed at an angle to a plane including the top or bottom surface of the artificial nail. Typically, the application tab is disposed at approximately a normal angle to a plane containing the top surface of the artificial nail when taken along the centerline, although the tab may be disposed at an alternate angle, preferably greater than 30°. The application tab may extend from one or more of any of the distal edge, or top or bottom surface of the nail. After placement, the application may be severed by any appropriate means. Separation may be facilitated by a weakened area provided by, for example, a perforation, an area of reduced thickness, a score line, or a reduced cross-sectional area.

In order to place the artificial nail on a natural nail, the user may grasp the generally vertically extending tab with the thumb and middle finger of the applying hand to apply the artificial nail to the natural nail of the receiving hand or a foot. Once the nail is placed, while continuing to hold the application tab, the user uses the index finger of the applying hand to lightly press the artificial nail into a final secured position on the receiving natural nail until such time as the adhesive secures the artificial nail in place. The user may then sever the application tab from the artificial nail by any appropriate means, such as snapping, tearing, or cutting. In this way, the artificial nail with tab provides ergonomic arrangement that facilitates nail placement with one hand.

The kit may further include an adhesive, a towelette including a cleaner, a roughening surface, a stick, and/or a placement tool.

These and other objects and advantages of the invention will be apparent to those skilled in the art upon reading the following summary and detailed description and upon reference to the drawings.

DETAILED DESCRIPTION OF THE INVENTION

Figure 1:
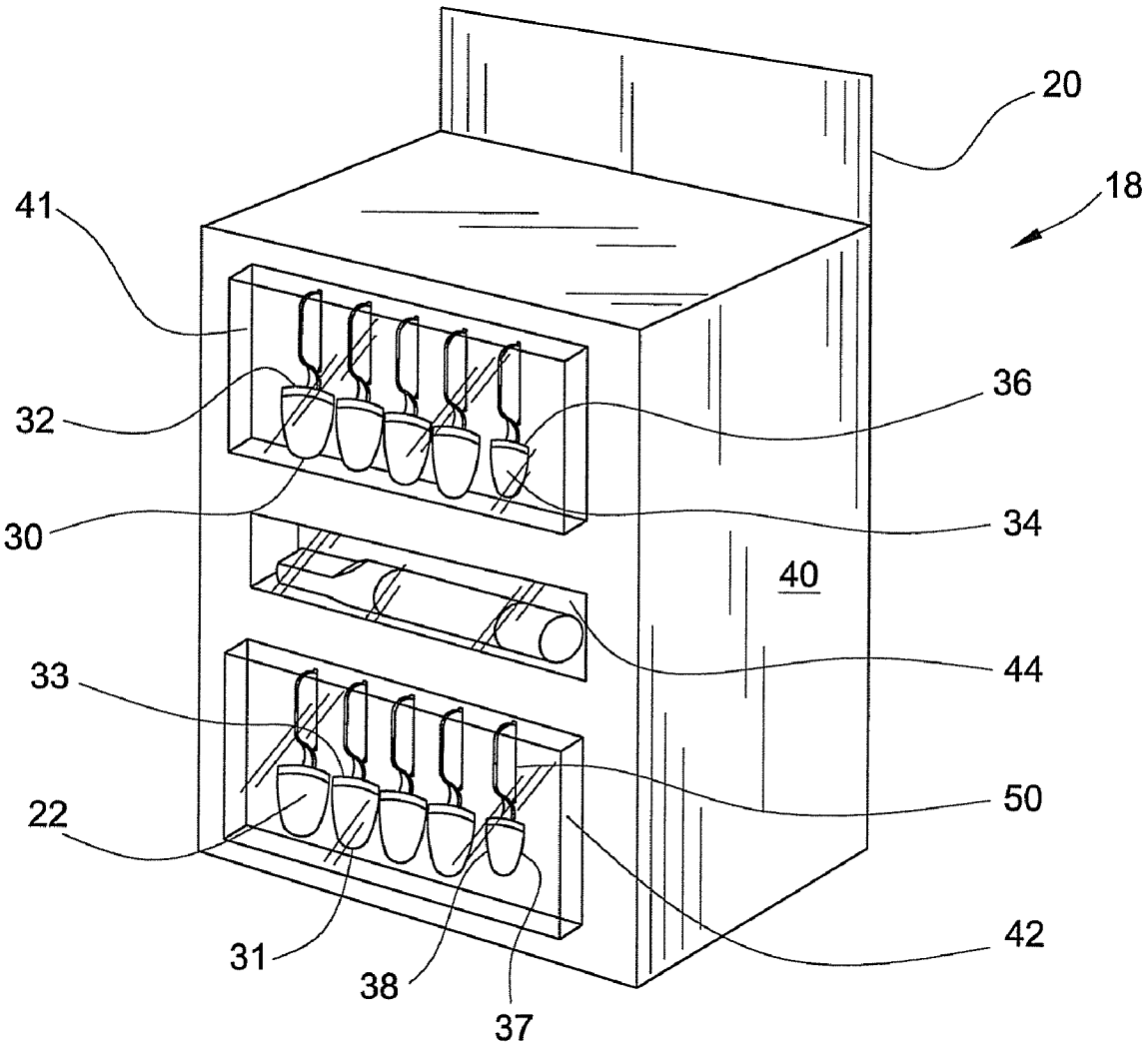
FIG. 1 is a perspective view of a kit having exemplary contents, including an artificial nail according to teachings of the invention.

Turning now to the drawings, wherein like reference numbers refer to like elements, there is illustrated in FIG. 1 a nail kit 18 comprising a package 20 containing a plurality of preformed artificial nail assemblies. Each nail assembly comprises an artificial nail 22 which has a proximal end 30, adapted to be placed generally adjacent the user's cuticle, and a distal end 32 that is generally disposed at or beyond the end of the user's natural nail when properly placed. The areas between the proximal and distal ends 30, 32 of the artificial nail 22 generally define the nail bed portion 34 and the free end 36, the nail bed portion 34 being adapted to be placed adjacent the user's natural nail bed and the free end portion 36 being adapted to extend beyond the end of the user's finger. The artificial nails 22 further include right and left side edges 37, 38 with the nail 22 having a generally arched contour between the side edges 37, 38 and a generally less arched contour between the proximal and distal edges 31, 33.

The nail kit package 20 typically includes an outer covering 40, here in the form of a box, having at least one transparent portion 41 for viewing the contents of the package 20. The package 20 further includes an inner support housing 42 that generally retains the contents of the package 20 in position within the package 20. The inner support housing is typically formed of a polymeric material. The inner support housing 42 generally includes a plurality of recessed areas 44, and additional contents of the package 20 may be retained in a rear open portion of the inner support housing 42.

In accordance with the invention, the artificial nail assembly includes an application tab arrangement 50 to ergonomically facilitate placement of the artificial nail 22 on a natural nail. The tab arrangement 50 includes a body 52 for the user to grasp during placement, and a neck 54 that extends between the body 52 and the nail 22. According to an important feature of the invention, at least a portion of the body 52 is disposed at an angle to a plane containing the upper or lower surface 39 of the nail 22 generally along its centerline 23. Significantly, the portion of the body 52 disposed at an angle to the plane must be sufficiently large to be grasped by a user during placement of the nail 22.

Figures 2, 3, 4:
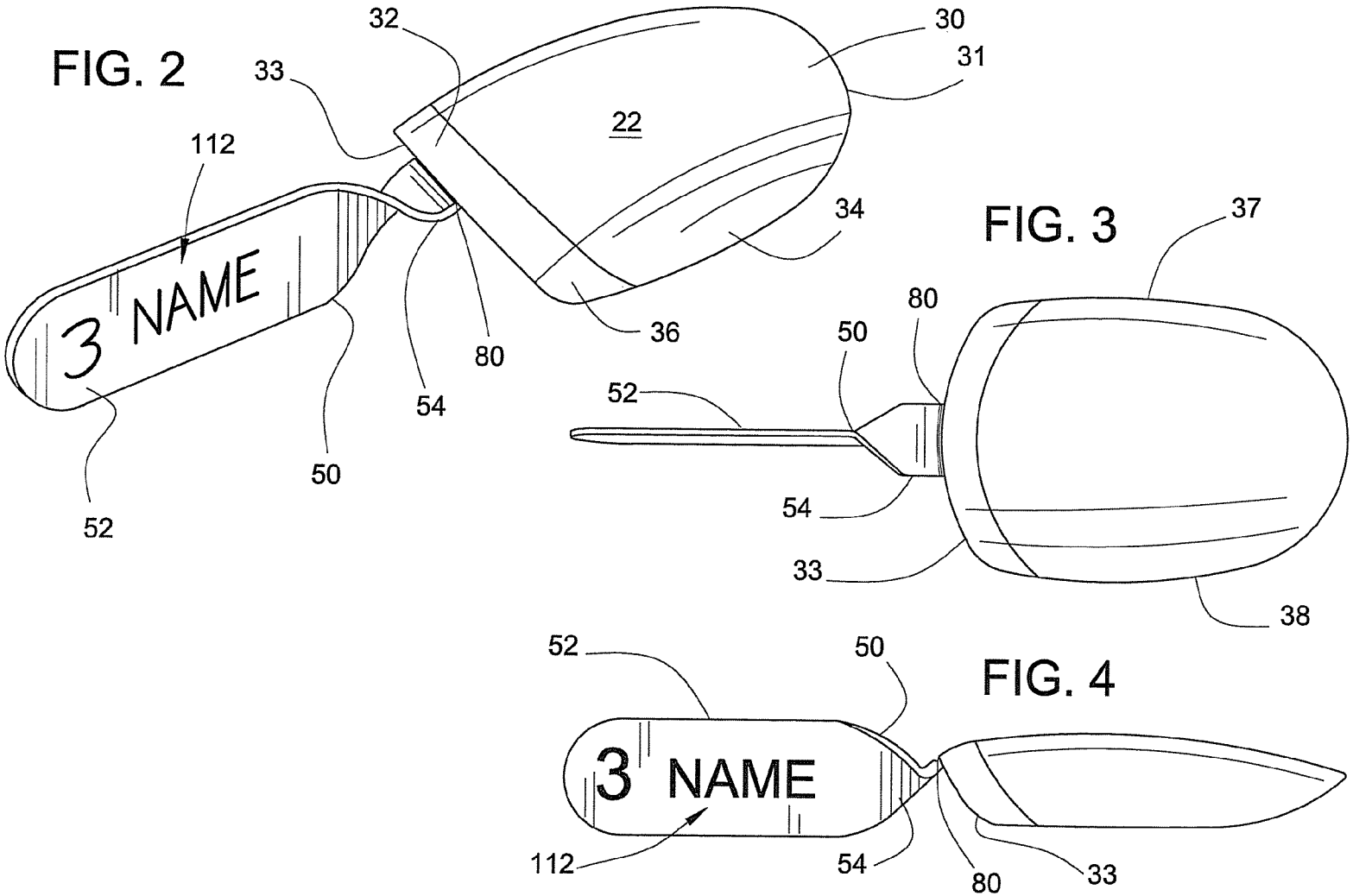
FIG. 2 is a perspective view of an artificial nail with application tab constructed in accordance with teachings of the invention.
FIG. 3 is top plan view of the artificial nail of FIG. 2.
FIG. 4 is a side elevational view of the artificial nail of FIGS. 2 and 3.
Figures 5, 6, 7, 7A:
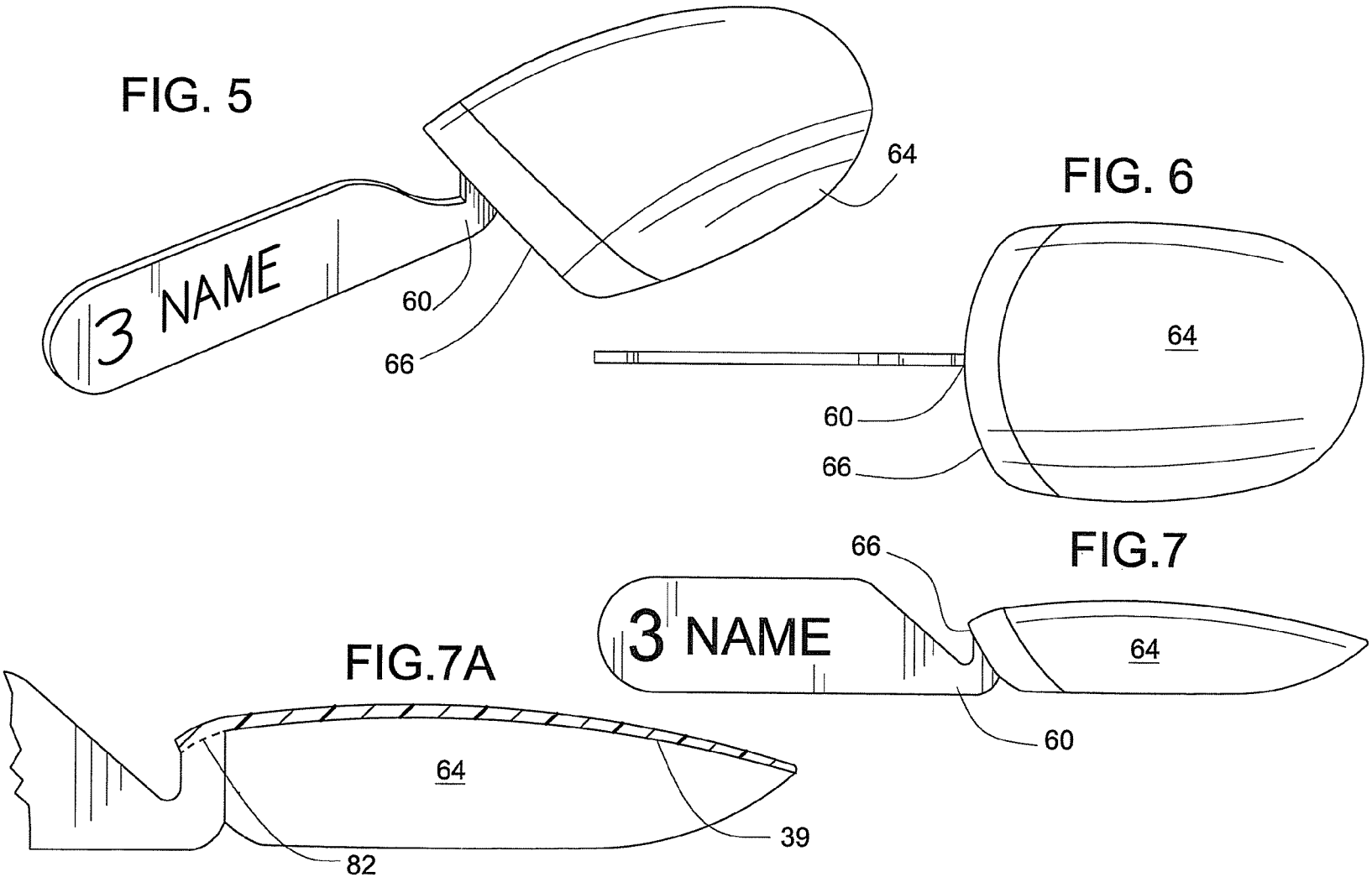
FIG. 5 is a perspective view of an alternate embodiment of an artificial nail with application tab constructed in accordance with teachings of the invention.
FIG. 6 is a top plan view of the artificial nail of FIG. 5.
FIG. 7 is a side view of the artificial nail of FIGS. 5 and 6.
FIG. 7A is a cross-sectional view of the artificial nail of FIGS. 5-7.
Figure 8:
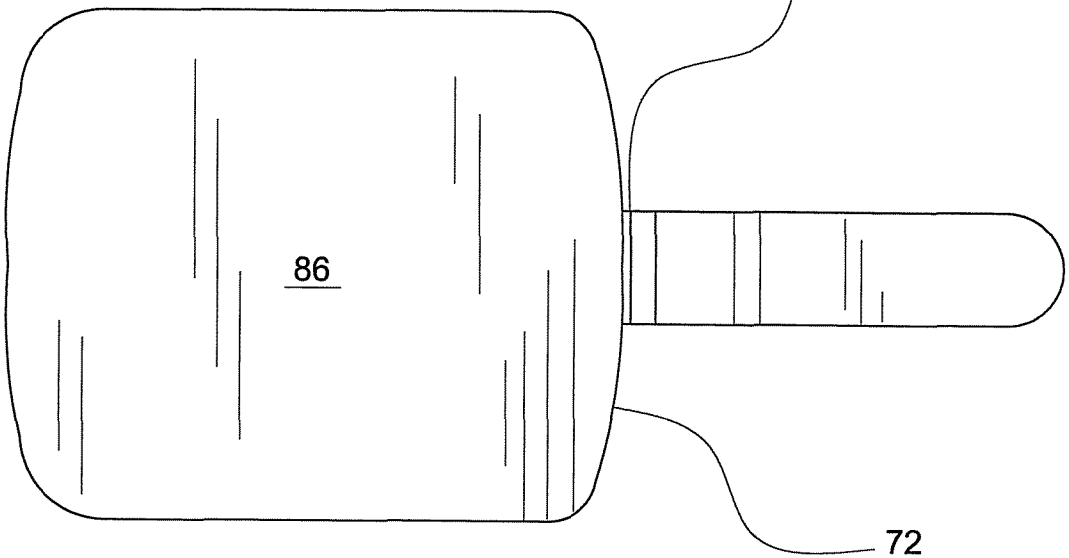
FIG. 8 is a top plan view of another alternate embodiment of an artificial nail with application tab constructed in accordance with teachings of the invention.
Figure 9:
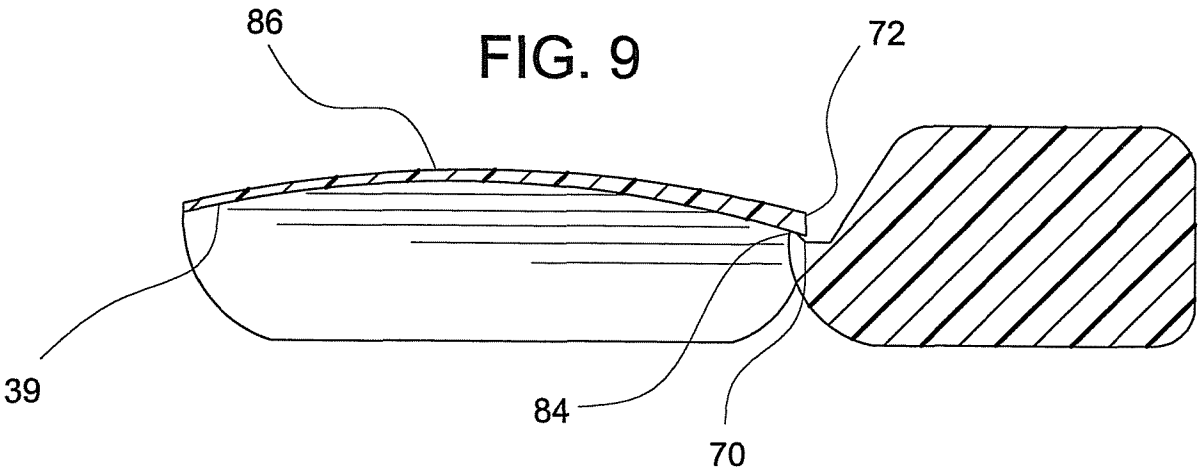
FIG. 9 is a side cross-sectional view of the artificial nail of FIG. 8.

The neck 54 attaches the body 52 to the nail 22 at its distal end 32. While the neck 54 may extend from the distal edge 33, as shown in FIGS. 2-4, it may alternately extend from the upper or lower surface 39 of the artificial nail 22 or a combination of the distal edge 33 and one or both of the upper or lower surfaces 39. As shown in FIGS. 5-7, for example, the neck 60 may extend from the lower surface 39. It will be appreciated by those of skill in the art that when the neck 60 is separated from the nail 64, the neck 60 will not leave any sharp edges or points protruding from the distal edge 66 of the nail 64. In this embodiment, the neck 60 extends from the lower surface 39 proximate to the distal edge 66, while in the embodiment of FIGS. 8-9, the neck 70 is spaced back slightly from the distal edge 72 of the nail 86.

According to a feature of the invention, once appropriately placed, the tab arrangement 50 may be separated from the nail 22 by any appropriate mechanism. For example, the neck 54 of the tab arrangement 50 may include a weakened area, such as, for example, a thinned section 80 substantially adjacent the distal edge 33 of the nail 22, similar to the arrangement shown in FIGS. 2-4, a perforation 82, as shown, for example, in FIG. 7A, a relatively small cross-section 84 at the location where the neck 70 meets the nail 86, such as is as shown, for example in FIG. 9, a score line, or any combination of such structures. While less desirable, those of skill in the art will appreciate that the tab arrangement 50 could alternately be severed from the nail 22 by a tool, such as scissors or a blade.

Figure 10A:
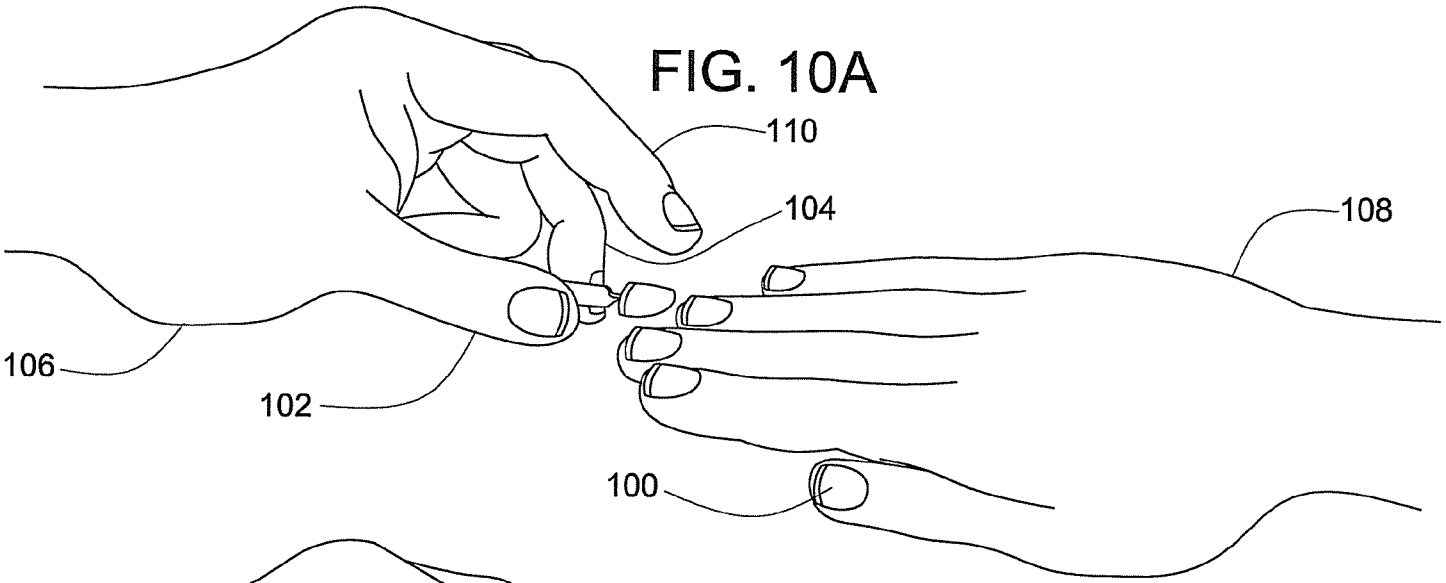
FIGS. 10A and 10B are perspective views of the artificial nail of FIGS. 2-4 during placement on a natural nail.
Figure 10B:
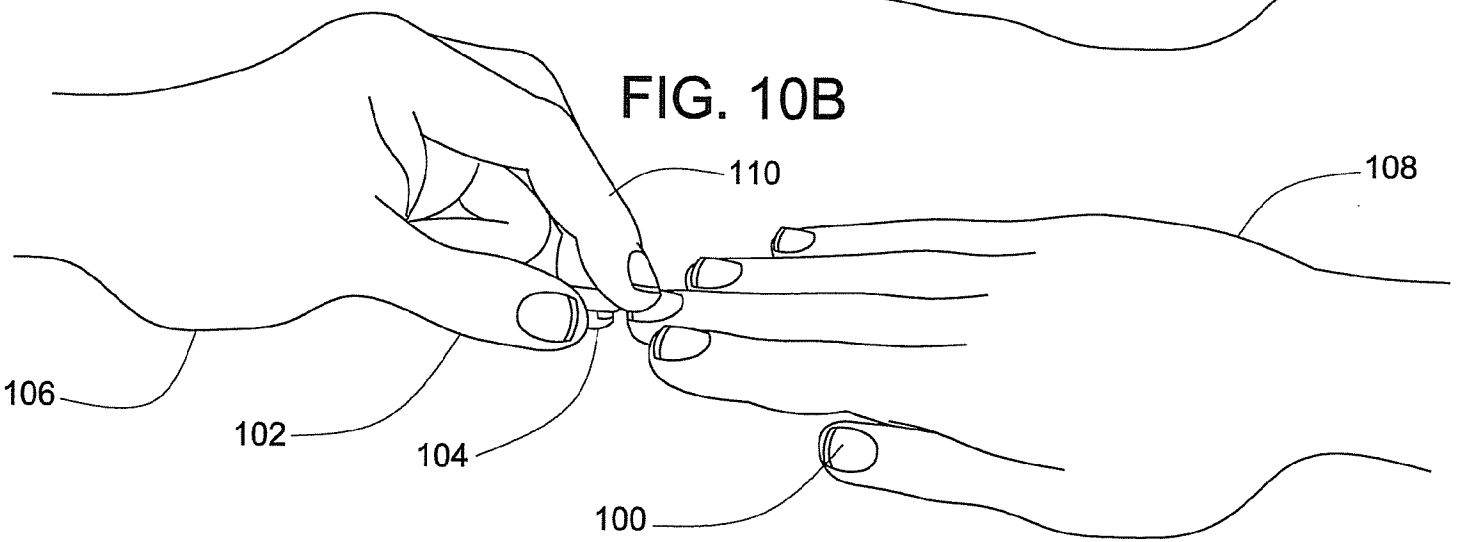
Figure 11:
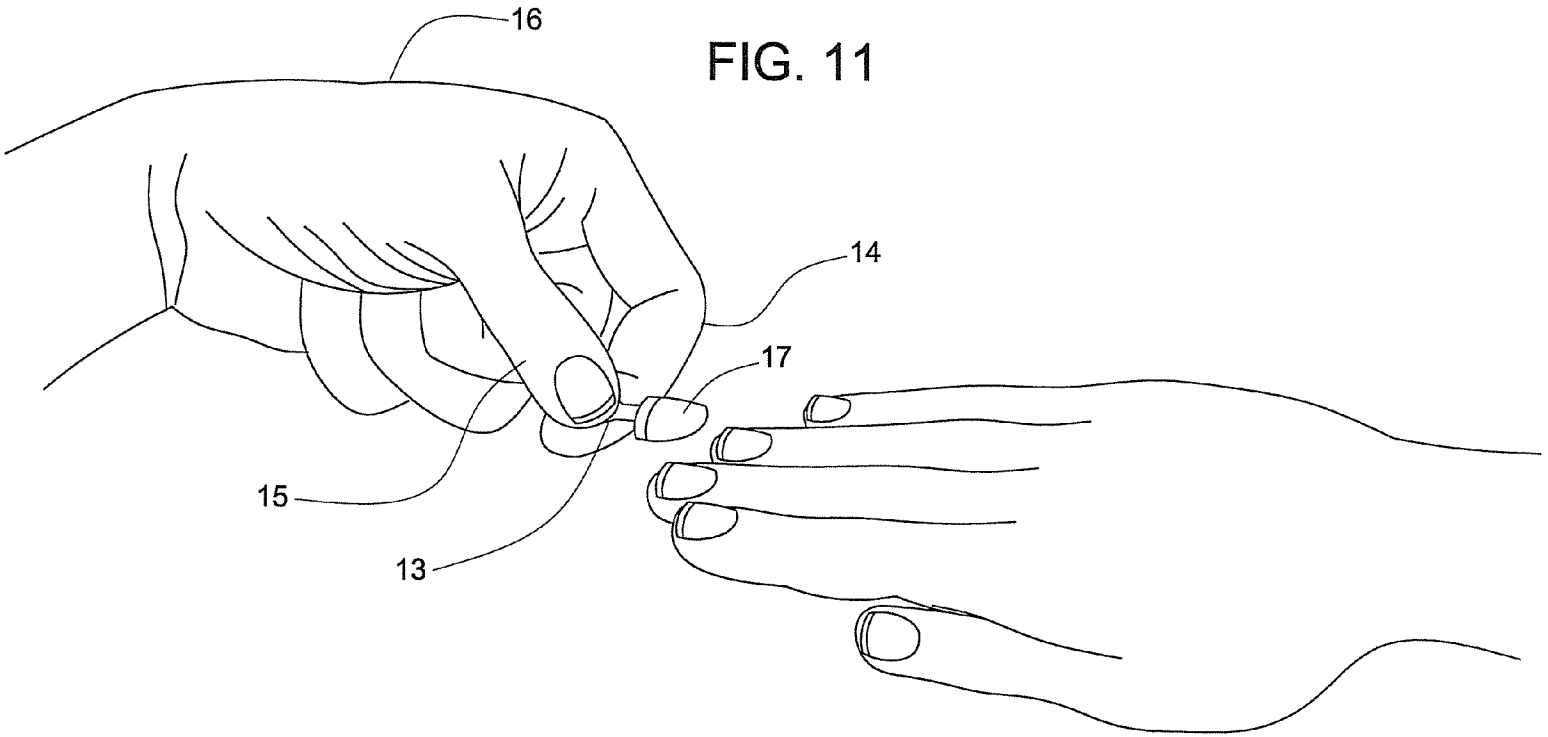
FIG. 11 PRIOR ART
FIG. 11 is a perspective view of an artificial nail arrangement of the prior art during placement on a natural nail.

Turning to FIGS. 10A and 10B, according to an important feature of the invention, a user may easily apply the artificial nail 22 to a natural nail 100 in a coordinated and ergonomic manner. More specifically, when applying the artificial nail 22 to a natural nail 100, the user may grasps the body 52 of the tab arrangement 50 between the thumb 102 and middle finger 104 of the applying hand 106 to position the artificial nail 22 on the natural nail 100 of the receiving hand 108, as shown in FIG. 10A. Once the user has placed artificial nail 22 on the natural nail 100, while continuing to hold the body 52 of the tab arrangement 50, the user may then utilize the index finger 110 of the applying hand 106 to place a retaining force on the upper surface of the situated artificial nail 22, as shown in FIG. 10B, in order to ensure proper seating of the artificial nail 22 and distribution of the adhesive. If desired, while continuing to apply a downward force, the user may further use the thumb 102 and middle finger 104 of the applying hand 106 to separate the tab arrangement 50 from the artificial nail 22, should the arrangement 50 include a weakened area as the mechanism for facilitating separation. In this way, the user may easily and quickly apply a plurality of artificial nails to respective natural nails to obtain a polished, manicured appearance.

It will thus be appreciated by those of skill in the art that the disposition of the body 52 at an angle to the upper or lower surfaces of the artificial nail 22 provides an ergonomic arrangement that is easily utilized to place the nail. The angled disposition is as opposed to a tab in a generally continuous plane with the nail, as provided, for example, in U.S. Pat. No. 6,892,736 to Chinn et al. or U.S. Pat. No. 5,005,595 to Aylott. The angle must be sufficient to allow the user to comfortably grasp the body 52 and place the nail 22. While a normal angle is generally preferable inasmuch as it allow the user to readily place the nail using either the left or right hand, an angle of at least 30° to either the top or bottom surface of the nail 22 will typically be adequate to facilitate grasping and placing the nail 22.

In order to further assist the user in artificial nail choice, at least the body 52 of the tab arrangement 50 may be sufficiently wide to display information for the user. Thus, the tab 50 may include indicia 112 such as, for example, the size number of the accompanying nail, the name of the manufacturer, a trademark or tradename, the nail color or instructions. The indicia 112 may provided on the tab arrangement 50 by any appropriate mechanism, such as, for example, molding the indicia into the arrangement, or printing the indicia thereupon. In this way, such indicia 112 may facilitate the user's choice of nail for application.

It will be appreciated that the preformed artificial nails 22 utilized in the nail kit 18 may be of any appropriate design. For example, the invention may likewise be utilized in connection with a nail tip, as opposed to a full nail, as illustrated in the figures. Thus, for the purposes of this disclosure and the claims appended hereto, the term "nail" will be used to correspond to both a full nail and a nail tip. Those of skill in the art will appreciate that the nail tip is essentially the same as a full nail with the exception that the nail tip includes only a portion that is adapted to cover only a distal portion of the natural nail. Moreover, the nail kit may include additional items, such as, by way of example only, an appropriate adhesive, such as is shown in FIG. 1, a rough or emery type surface for buffing the natural nail prior to placement of the artificial nail, a towelette including an acetone or other substance to clean the nail prior to placement, a rosewood stick and/or an application tool for assistance during installation of the artificial nail onto the natural nail surface.

While this invention has been described with an emphasis upon preferred embodiments, variations of the preferred embodiments can be used, and it is intended that the invention can be practiced otherwise than as specifically described herein. Accordingly, this invention includes all modifications encompassed within the spirit and scope of the invention as defined by the following claims.

All of the references cited herein, including patents, patent applications, and publications, are hereby incorporated in their entireties by reference.

We claim as our invention:

1. A kit of preformed artificial nails, the kit comprising a plurality of preformed artificial nail assemblies for placement on a natural nail by a user, said artificial nail assembly comprising an artificial nail sized to correspond to at least a portion of said natural nail, the artificial nail including a proximal end adapted to be placed along the natural nail, and a free edge portion defining a distal end, said distal end defining an artificial nail distal edge, the artificial nail having an upper surface and a lower surface, an application tab extending from the distal end of the artificial nail, the application tab having a neck portion and a body portion, said neck portion being disposed between the body portion and the distal end of the artificial nail, the body portion including a transverse width and a thickness, the width being generally greater than the thickness such that the body portion may be readily grasped by the user to facilitate placement of the artificial nail on the natural nail, at least a portion of the width of the body portion of the tab being disposed at other than at a 90° angle to a plane extending through a longitudinal axis extending from the proximal end to the distal end of the artificial nail through said neck portion, the plane extending generally perpendicularly from at least one of the upper and lower surfaces of the nail, and a package, the artificial nails being disposed within the package.

2. The kit of claim 1 wherein the body of the application tab is disposed at least on the order of 30 degrees to the upper surface.

3. The kit of claim 1 wherein the neck of the application tab includes a weakened area substantially adjacent the artificial nail, said weakened area facilitating separation of the application tab from the artificial nail.

4. The kit of claim 3 wherein the weakened area includes at least one of a perforation, an area of reduced thickness, a score line, a cut, or a reduced cross-sectional area relative to the remainder of the neck.

5. The kit of claim 1 wherein the application tab includes indicia.

6. The kit of claim 5 wherein said indicia relates to said supported nail.

7. The kit of claim 5 wherein said indicia is at least one of printed on said body or molded with said body.

8. The kit of claim 1 wherein the neck includes a portion that twists from the body to the artificial nail.

9. The kit of claim 1 wherein the artificial nail and application tab are simultaneously molded together.

10. The kit of claim 1 further comprising at least one of the following: an adhesive, a nail wipe, a manicuring tool, a placement tool, and nail polish.

11. The kit of claim 1 wherein at least a portion of application tab is substantially disposed within the plane.

12. A preformed artificial nail assembly for placement on a natural nail by a user, said artificial nail assembly comprising:

an artificial nail sized to correspond to at least a portion of said natural nail, the artificial nail including a proximal end adapted to be placed along the natural nail, and a free edge portion defining a distal end, said distal end defining an artificial nail distal edge, the artificial nail having an upper surface, an application tab extending from the distal end of the artificial nail, the application tab having a neck portion and a body portion, said neck portion being disposed between the body portion and the distal end of the artificial nail, the body portion including a transverse width and a thickness, the width being generally greater than the thickness such that the body portion may be readily grasped by the user to facilitate placement of the artificial nail on the natural nail, at least a portion of the width of the body portion of the tab being disposed at other than at a 90° angle to a plane extending through a longitudinal axis extending from the proximal end to the distal end of the artificial nail through said neck portion, the plane extending generally perpendicularly from at least one of the upper and lower surfaces of the nail.

13. The artificial nail assembly of claim 12 wherein the body of the application tab is disposed at least on the order of 30 degrees to the upper surface.

14. The artificial nail assembly of claim 12 wherein the neck of the application tab includes a weakened area substantially adjacent the artificial nail, said weakened area facilitating separation of the application tab from the artificial nail.

15. The artificial nail assembly of claim 14 wherein the weakened area includes at least one of a perforation, an area of reduced thickness, a score line, a cut, or a reduced cross-sectional area relative to the remainder of the neck.

16. The artificial nail assembly of claim 12 wherein the application tab includes indicia.

17. The artificial nail assembly of claim 12 wherein the neck includes a portion that twists from the body to the artificial nail.

18. The artificial nail assembly of claim 12 wherein the application tab is secured with the artificial nail at the distal edge.

19. The artificial nail assembly of claim 12 wherein the artificial nail includes a bottom surface, and the application tab is secured to the bottom surface of the artificial nail.

20. The artificial nail assembly of claim 12 wherein at least a portion of the application tab is substantially disposed within the plane.

* * * * *